US006397631B1

(12) United States Patent
Griffiths et al.

(10) Patent No.: US 6,397,631 B1
(45) Date of Patent: Jun. 4, 2002

(54) AIR SEPARATION PROCESS

(75) Inventors: John Louis Griffiths, Pittsburgh, PA (US); Paul Higginbotham, Guildford (GB)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 09/879,232

(22) Filed: Jun. 12, 2001

(51) Int. Cl.[7] ..... F25J 3/00
(52) U.S. Cl. ..... 62/646
(58) Field of Search ..... 62/643, 646, 653, 62/654

(56) References Cited

U.S. PATENT DOCUMENTS

| | | | | |
|---|---|---|---|---|
| 3,688,513 A | | 9/1972 | Streich et al. | 62/22 |
| 4,254,629 A | | 3/1981 | Olszewski | 62/13 |
| 4,533,375 A | | 8/1985 | Erickson | 62/22 |
| 4,582,518 A | | 4/1986 | Erickson | 62/25 |
| 4,605,427 A | | 8/1986 | Erickson | 62/22 |
| 5,069,699 A | | 12/1991 | Agrawal | 62/24 |
| 5,402,647 A | | 4/1995 | Bonaquist et al. | 62/24 |
| 5,471,843 A | * | 12/1995 | Chretien | 62/646 |
| 5,485,729 A | | 1/1996 | Higginbotham | 62/25 |
| 5,730,004 A | | 3/1998 | Voit | 62/646 |
| 5,906,113 A | | 5/1999 | Lynch et al. | 62/646 |
| 5,918,482 A | | 7/1999 | Potempa | 62/646 |
| 5,964,104 A | | 10/1999 | Rottmann | 62/650 |
| 6,257,019 B1 | * | 7/2001 | Oakey et al. | 62/646 |

FOREIGN PATENT DOCUMENTS

| | | | |
|---|---|---|---|
| EP | 0924486 | 6/1999 | F25J/3/04 |
| EP | 9921367 | 6/1999 | F25J/3/04 |
| EP | 1043558 | 10/2000 | F25J/3/04 |
| JP | 1062062 | 6/1998 | F25J/3/04 |
| WO | WO98/19122 | 5/1998 | F25J/3/04 |
| WO | WO00/60294 | 10/2000 | F25J/3/04 |

* cited by examiner

*Primary Examiner*—William C. Doerrler
(74) *Attorney, Agent, or Firm*—Willard Jones, II

(57) ABSTRACT

A process for the cryogenic distillation of air uses a distillation column system having a supplemental column and a distillation unit including a lower-pressure column and a higher-pressure column. A liquid stream enriched in oxygen is withdrawn from the lower-pressure column and is eventually vaporized through indirect latent heat transfer, thereby producing a reflux stream, a portion of which is eventually sent to the lower-pressure column, the higher-pressure column, and/or the supplemental column. At least a portion of the reflux for the supplemental column is eventually derived from the distillation unit. A nitrogen-enriched liquid removed from the distillation unit is increased in pressure and is fed to the supplemental column or back to the distillation unit. An oxygen-enriched fluid from the bottom of the supplemental column is fed to the distillation unit. At least some of the nitrogen product from the supplemental column is returned to the distillation unit.

11 Claims, 7 Drawing Sheets

AIR SEPARATION PROCESS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

The present invention relates generally to processes for the cryogenic distillation of air, and in particular to such processes used to produce at least a nitrogen product.

There are numerous processes which relate to the production of at least a nitrogen product by cryogenic air separation. Frequently these processes have a double column distillation unit, which utilizes a higher-pressure column and a lower-pressure column. Typically, though not exclusively, the higher-pressure column obtains a portion of its reflux through the use of a reboiler-condenser. Herein a vapor in the higher-pressure column is condensed through indirect latent heat transfer with a liquid in the lower-pressure column. Air is primarily fed to the higher-pressure column, but occasionally also may be introduced to the lower-pressure column. Meanwhile, products may be removed from either column.

Many of these processes are concerned with once through separation, wherein all fluids flow from higher pressures to lower pressures. Typically, the highest-pressure stream in once through separation cycles is a compressed air stream. These once through cycles produce products from the distillation unit at pressures no greater than that of the higher-pressure column. Post-separation compression allows for the production of products at pressures other than those found in the cryogenic air separation process. Two such embodiments of post-separation compression are found in pumped LOX cycles and pumped LIN cycles. In these embodiments a liquid product is removed from the distillation unit, pumped to an elevated pressure, and delivered to a warm elevated pressure product. In JP 1062062, U.S. Pat. No. 5,906,113 (Lynch et al.), U.S. Pat. No. 4,582,518 (Erickson) and U.S. Pat. No. 5,918,482 (Potempa), liquid nitrogen is removed from a single column cycle and provides a portion of the reflux for an additional column.

A second set of cycles exist wherein a liquid stream is removed from the lower-pressure column and its pressure increased, for example through pumping. This elevated pressure stream is eventually returned to the cryogenic air separation cycle. These cycles may be described as pump-back cycles, and do not pertain to the set of once through cycles.

An advantage of a pump-back cycle is that products may be produced at pressures greater than that of the lower-pressure column. These cycles are especially beneficial if a single, high pressure product is required. However, the pressure of the product stream is still bounded by the pressures found in the higher and lower-pressure columns.

In U.S. Pat. No. 5,964,104 (Rottmann) liquid nitrogen from the lower-pressure column of a double column cycle is pumped to the higher-pressure column where it is used as reflux. In WO 98/19122 (Corduan) liquid nitrogen from the lower-pressure column of a double column cycle is pumped to a heat exchanger where it is either fully or partially vaporized. A portion of the reflux for the higher-pressure column is provided by indirect condensation with this boiling pumped liquid nitrogen. These cycles just described do not contain additional columns.

A third set of cycles exists where an additional or supplemental column is used. These supplemental columns are known in the prior art as Intermediate Pressure Columns (IP), or Medium Pressure Columns (MP). Most of these cycles improve the once through cycles by removing a product at a pressure between that of the higher-pressure column and the lower-pressure column. A typical method of operation is when a stream of liquid is removed from the higher-pressure column to reflux the supplemental column. This removal of higher-pressure reflux tends to reduce the production of nitrogen product from the higher-pressure column. The pressure of the nitrogen product from this supplemental column remains bounded between the higher and lower-pressure columns.

In U.S. Pat. No. 5,069,699 (Agrawal) air is sent to the higher-pressure column of a double column cycle and an extra high pressure (EHP) column. A gaseous nitrogen stream from the EHP column is condensed indirectly with an oxygen enriched liquid in the lower-pressure column. A portion of this condensed EHP gaseous nitrogen stream is used as reflux for the high-pressure (HP) column. In EP 0921367 and EP 0924486 liquid nitrogen produced in the third column, at a pressure typically around 90 psia, may be used as reflux for both the higher-pressure and lower-pressure columns. In all of these cycles no portion of the nitrogen product is removed from the additional column.

In U.S. Pat. No. 3,688,513 (Streich, et al.) liquid nitrogen from the lower-pressure column of a double column cycle is pumped and used as a portion of the reflux for the IP column. A product of enriched oxygen is removed from the bottom of the IP column. In this cycle an oxygen enriched liquid from the bottom of the IP column is not sent to the distillation unit.

In U.S. Pat. No. 4,533,375 (Erickson) and U.S. Pat. No. 4,605,427 (Erickson) the lower-pressure column is refluxed through the vaporization of liquid nitrogen. In these cases just described, the vaporizing liquid has an oxygen concentration less than that of air.

In U.S. Pat. No. 5,730,004 (Voit) and U.S. Pat. No. 4,254,629 (Olszewski) air is sent to an IP column. Reflux for this IP column is provided by condensing nitrogen indirectly against a boiling oxygen enriched liquid. A portion of the condensed IP nitrogen liquid is used as reflux to the lower-pressure column of a double column cycle. In U.S. Pat. No. 5,485,729 (Higginbotham) an IP column derives reflux by condensing gaseous nitrogen in intermediate reboiler condensers located within a lower-pressure column of a double column cycle. A portion of the liquid nitrogen produced is used to reflux the lower-pressure column. In U.S. Pat. No. 5,402,647 (Bonaquist, et al.) a third column, operating at a pressure generally between 30 psia and 60 psia, produces a liquid nitrogen product, which is pumped to the higher-pressure column where it is used as reflux. In these cases, no liquid from the distillation unit is raised in pressure and sent to either the additional column or returned to the distillation unit.

In EP 1043558 (Brugerolle) liquid nitrogen is pumped from a distillation unit to a power producing cycle. Herein, an oxygen-enriched fluid is recovered and returned to the distillation unit. The nitrogen-enriched gas produced from the top of the column is injected into the gas turbine ensuring that the mass flowrate to the expander is not compromised.

This reference describes the increase of production of oxygen from the distillation unit and also describes cycles known in the prior art as oxygen plants. A liquid stream is therefore not removed from the lower-pressure column and vaporized in such a manner that a reflux stream is produced.

It is desired to have an improved air separation process for the production of nitrogen.

It is further desired to have an improved air separation process for the production of nitrogen which overcomes the difficulties and disadvantages of the prior art processes to provide better and more advantageous results.

BRIEF SUMMARY OF THE INVENTION

A first embodiment of the invention is a process for separating a multi-component fluid comprising oxygen and nitrogen to produce nitrogen. The process uses a distillation column system having at least three distillation columns, including a higher-pressure column operating at a first pressure, a lower-pressure column operating at a second pressure lower than the first pressure, and a supplemental column operating at a third pressure greater than or equal to the second pressure. The higher-pressure column and the lower-pressure column are thermally linked through a first heat exchanger. Each distillation column has a top, a bottom, and a plurality of locations between the top and the bottom. The process includes multiple steps. The first step is to feed a first stream of the multi-component fluid to the higher-pressure column. The second step is to feed a second stream of the multi-component fluid or another multi-component fluid comprising oxygen and nitrogen to the supplemental column. The third step is to withdraw a first nitrogen-rich vapor stream from the higher-pressure column or the lower-pressure column. The fourth step is to withdraw a first oxygen-rich liquid stream from the lower-pressure column. The fifth step is to heat exchange at least a portion of the first oxygen-rich liquid stream indirectly against at least a portion of the first nitrogen-rich vapor stream in the first heat exchanger or a second heat exchanger, thereby at least partially vaporizing the first oxygen-rich liquid stream and at least partially condensing the first nitrogen-rich vapor stream. The sixth step is to eventually change the pressure of at least a portion of the condensed first nitrogen-rich vapor stream. The seventh step is to eventually feed at least a portion of the condensed first nitrogen-rich vapor stream to the supplemental column. The eighth step is to withdraw a second oxygen-rich liquid stream from the supplemental column. The ninth step is to feed at least a portion of the second-oxygen-rich liquid stream to the lower-pressure column or the higher-pressure column. The tenth step is to withdraw a first stream of nitrogen product from the supplemental column.

There are several alternate embodiments of the invention. One alternate embodiment is similar to the first embodiment but includes the additional step of withdrawing a stream of a product enriched in oxygen from the lower-pressure column. Another alternate embodiment is similar to the first embodiment but includes the additional step of withdrawing a stream of product enriched in nitrogen from the higher-pressure column.

There also are many variations of the first embodiment. In one variation, the third pressure is greater than or equal to the first pressure. In another variation, a first nitrogen-rich liquid stream from the first heat exchanger is fed to the lower-pressure column at a first location, and a second nitrogen-rich liquid stream from the second heat exchanger is fed to the lower-pressure column at a second location above the first location.

In another variation of the first embodiment, the pressure of the portion of the condensed nitrogen-rich vapor stream is changed by reducing the pressure. A variant of this variation includes several additional steps. The first additional step is to withdraw a second nitrogen-rich vapor stream from the lower-pressure column. The second additional step is to withdraw a third oxygen-rich liquid stream from the lower-pressure column. The third additional step is to heat exchange at least a portion of the third oxygen-rich liquid stream indirectly against at least a portion of the second nitrogen-rich vapor stream in a second heat exchanger, thereby at least partially condensing the second nitrogen-rich vapor stream. The fourth additional step is to increase the pressure of at least a portion of the condensed nitrogen-rich vapor stream. The fifth additional step is to feed at least a portion of the condensed second nitrogen-rich vapor stream to the higher-pressure column.

In another variation of the first embodiment, the pressure of the portion of the condensed first nitrogen-rich vapor stream is changed by increasing the pressure. There are several variants of this variation. One variant includes several additional steps. The first additional step is to withdraw a second nitrogen-rich vapor stream from the supplemental column. The second additional step is to withdraw a third oxygen-rich liquid stream from the lower-pressure column. The third additional step is to heat exchange at least a portion of the third oxygen-rich liquid stream indirectly against at least a portion of the second nitrogen-rich vapor stream and a third heat exchanger, thereby at least partially condensing the second nitrogen-rich vapor stream. The fourth additional step is to feed at least a portion of the condensed second nitrogen-rich vapor stream to the supplemental column. In a variation of this variant, a portion of the condensed first nitrogen-rich vapor stream is fed to the supplemental column at a first location, and a portion of the condensed second nitrogen-vapor stream is fed to the supplemental column at a first location or at a second location above the first location.

Another aspect of the present invention is a cryogenic air separation unit using a process as in any of the embodiments, variations, or variants of the process discussed herein.

BRIEF DESCRIPTION OF THE DRAWINGS

The invention will be described by way of example with reference to the accompanying drawings, in which.

DETAILED DESCRIPTION OF THE INVENTION

The present invention is a process for the cryogenic distillation of air within a distillation column system that contains at least a distillation unit and a supplemental column. The distillation unit comprises at least a lower-pressure column and a higher-pressure column. A liquid stream enriched in oxygen is withdrawn from the lower-pressure column. This liquid is eventually vaporized through indirect latent heat transfer. The indirect latent heat transfer produces a reflux stream, a portion of which is eventually sent to the lower-pressure column, the higher-pressure column, and/or the supplemental column. At least a portion of the reflux for the supplemental column is eventually derived from the distillation unit. A nitrogen enriched liquid removed from the distillation unit is raised in pressure and is sent to either the supplemental column or back to the distillation unit. An oxygen-enriched fluid from the bottom of the supplemental column is sent to the distillation unit. At least a portion of the nitrogen product is removed from the supplemental column.

The pressure of the supplemental column is at least equal to the pressure of the lower-pressure column and may be greater than the pressure of the higher-pressure column.

Figure 1:
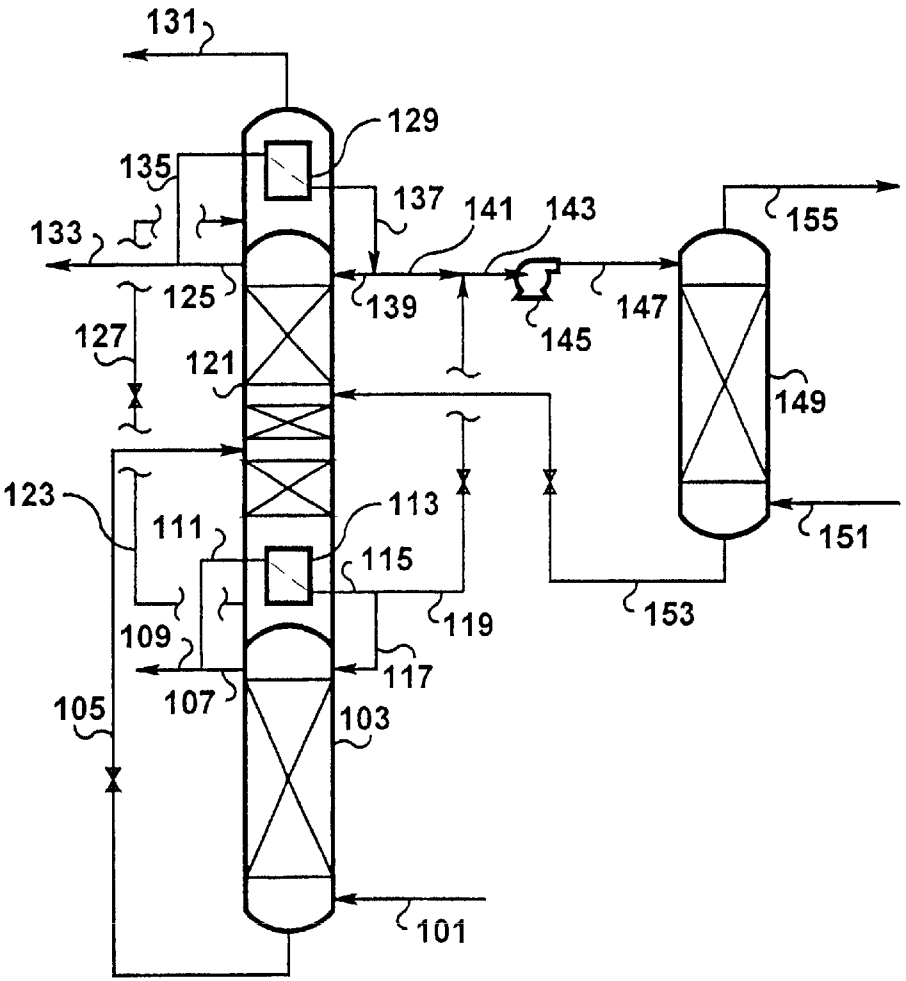
FIG. 1 is a schematic diagram of one embodiment of the present invention.

FIG. 1 shows an embodiment of the invention wherein liquid streams (141, 119) from both the lower-pressure column 121 and the higher-pressure column 103 combine to form a primary reflux stream 143 to reflux the supplemental column 149. The primary reflux stream is increased in pressure by a pump 145 before being fed to the supplemental column as supplemental column reflux stream 147.

Air component vapor stream 101, at a pressure typically between 80 psia and 300 psia, is fed to the higher-pressure column 103 wherein this stream is separated through cryogenic distillation into at least stream 105 (oxygen-rich) and stream 107 (nitrogen-rich). Stream 107 is divided into at least stream 109 and stream 111. Stream 111 is condensed indirectly in a first heat exchanger 113 against liquid in the bottom of the lower-pressure column 121, thereby producing stream 115, which stream is separated into at least stream 117 and stream 119. Stream 117 is eventually returned to the higher-pressure column 103. Stream 105 is eventually reduced in pressure and sent to the lower-pressure column wherein this stream is separated by cryogenic distillation into at least stream 123 and stream 125. Stream 123, a portion of the liquid from the bottom of the lower-pressure column, is eventually reduced in pressure and sent as stream 127 to a second heat exchanger 129, wherein the liquid is vaporized by indirect latent heat transfer, thereby producing waste stream 131. Stream 125 is divided into at least product stream 133 (nitrogen) and stream 135. Stream 135 is sent to a second heat exchanger 129 and is condensed by indirect latent heat transfer with stream 127, thereby producing stream 137. Stream 137 is divided into at least stream 139 and stream 141. Stream 139 is eventually returned to the lower-pressure column. Stream 141 is eventually mixed with stream 119 to produce the primary reflux stream 143, which is increased in pressure by pump 145 to become the supplemental column reflux stream 147, which is fed to the supplemental column 149. Secondary air component vapor stream 151 is fed to the supplemental column wherein this stream is separated by cryogenic distillation into at least stream 153 and primary nitrogen product stream 155. Stream 153 is eventually reduced in pressure and sent to the lower-pressure column.

Figure 2:
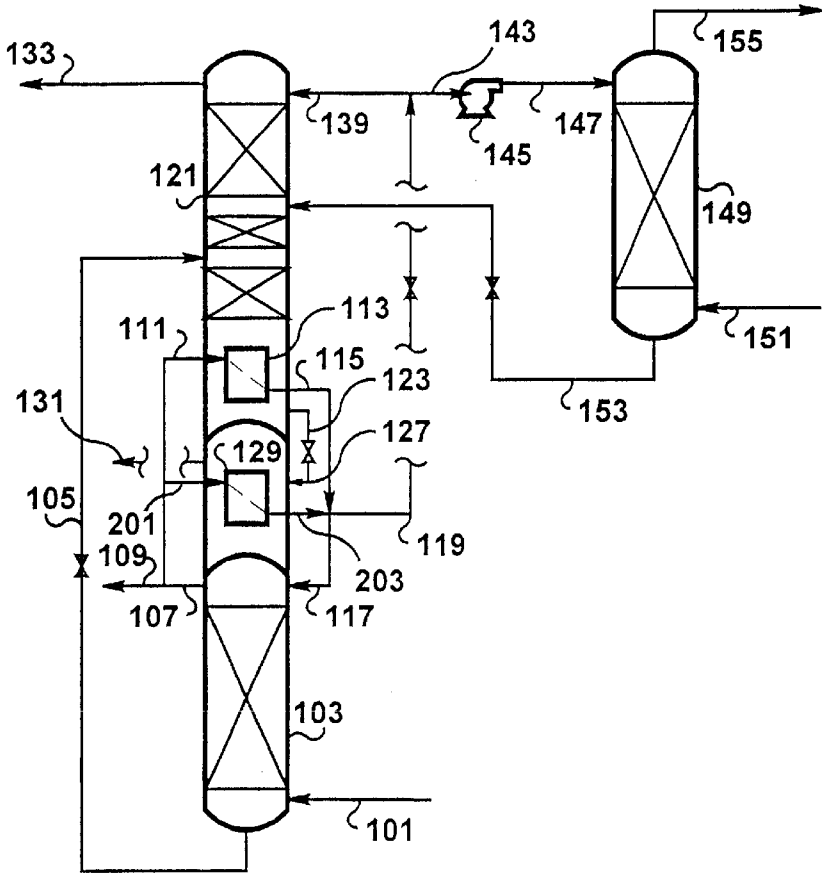
FIG. 2 is a schematic diagram of a second embodiment of the present invention.

FIG. 2 is an embodiment of the invention wherein reflux for the supplemental column 149 is derived from the higher-pressure column 103 only. Stream 201, a further portion of stream 107, is condensed in the second heat exchanger 129 through indirect latent heat transfer, thereby producing stream 203. Stream 203 is mixed with stream 115 from the first heat exchanger 113, thereby producing stream 117 and stream 119. Stream 139, now a portion of stream 1 19, is sent to the lower-pressure column 121. Stream 143, a further portion of stream 119, is eventually increased in pressure in pump 145 and sent to the supplemental column 149 as supplemental column reflux stream 147.

Figure 3:
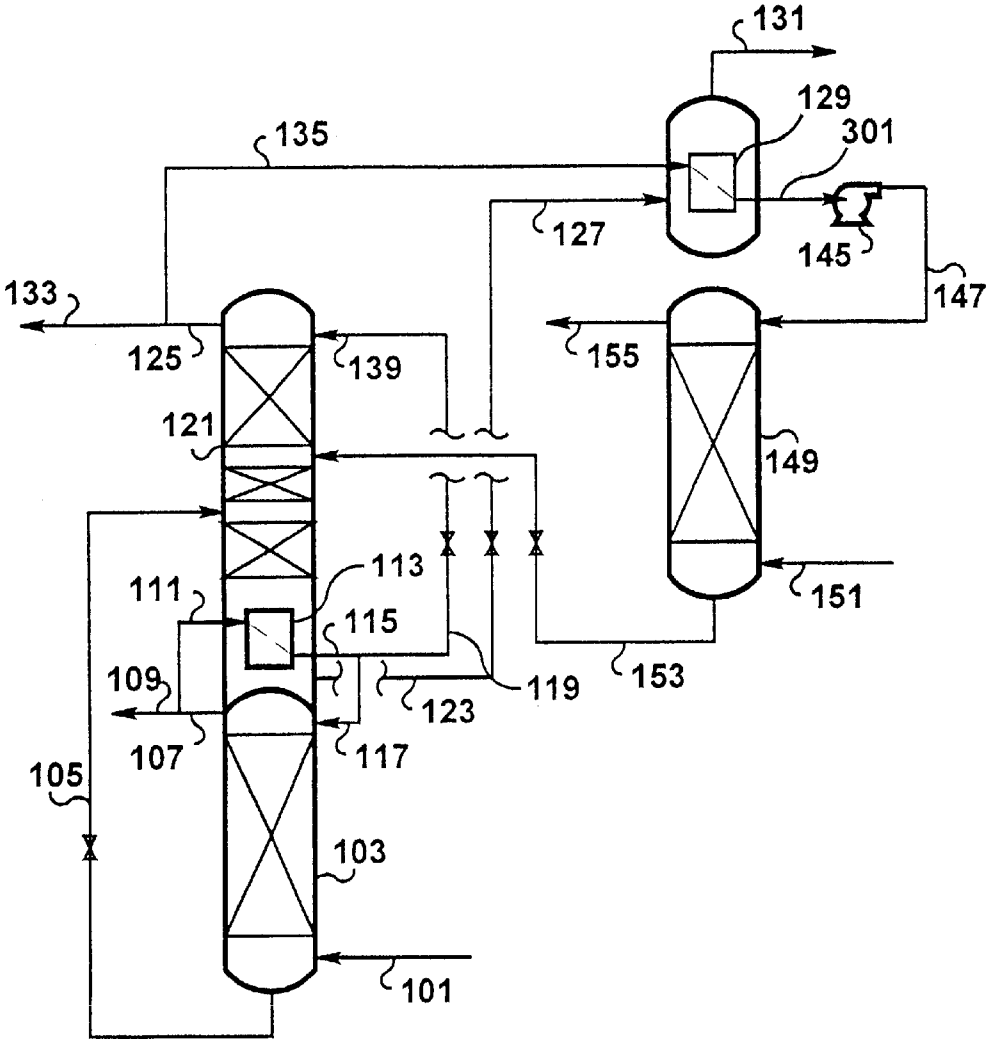
FIG. 3 is a schematic diagram of a third embodiment of the present invention.

FIG. 3 is an embodiment of the invention wherein reflux for the supplemental column 149 is derived from only the lower-pressure column 121. Stream 135 is condensed through indirect latent heat transfer in the second heat exchanger 129, thereby producing stream 301. Stream 301 is eventually increased in pressure in pump 145 and sent as supplemental column reflux stream 147 to the supplemental column 149.

Figure 4:
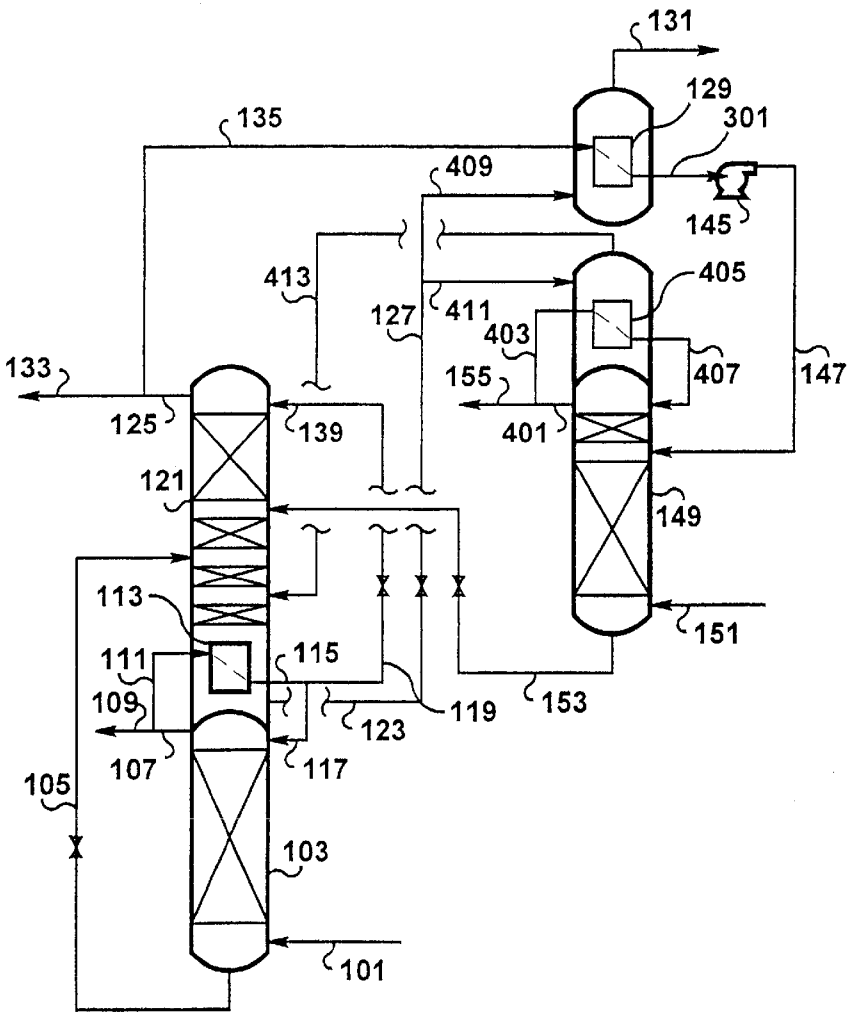
FIG. 4 is a schematic diagram of a fourth embodiment of the present invention.

FIG. 4 is an embodiment of the invention wherein a portion of the reflux for the supplemental column 149 is derived from the lower-pressure column 121 and a further portion of the reflux is derived from the supplemental column. Stream 127 is divided into at least stream 409 and stream 411. Stream 409 is vaporized through indirect latent heat transfer in the second heat exchanger 129, thereby producing stream 131. Stream 411 is vaporized through latent heat transfer in a third heat exchanger 405, thereby producing stream 413, which eventually is returned to the lower-pressure column 121. Stream 401 is removed from the top of the supplemental column 149 and is divided into at least primary nitrogen product stream 155 and stream 403. Stream 403 is condensed through indirect latent heat transfer in the third heat exchanger 405, thereby producing stream 407. Stream 407 is eventually returned to the supplemental column wherein it is used as reflux. It is preferable, though not necessary, that the feed position of stream 407 into the supplemental column be no lower than the feed position of the supplemental column reflux stream 147.

Figure 5:
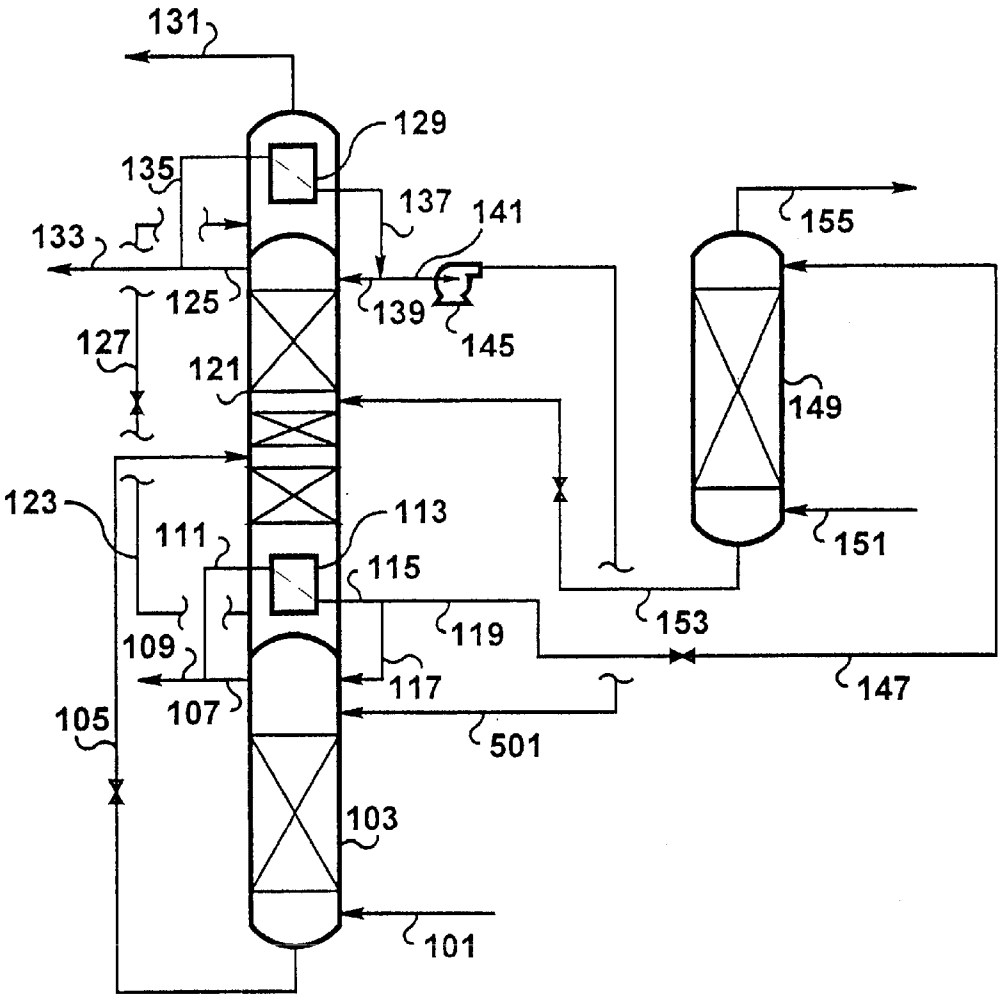
FIG. 5 is a schematic diagram of a fifth embodiment of the present invention.

FIG. 5 is an embodiment of the invention wherein a supplemental column reflux stream 147 solely from the higher-pressure column 103 refluxes the supplemental column 149 and a liquid stream 501 is pumped to the higher-pressure column 103 from pump 145. Stream 141 is raised in pressure in the pump and is eventually sent to the higher-pressure column as liquid stream 501. Stream 119 is eventually reduced in pressure and is sent to the supplemental column as supplemental column reflux stream 147.

Figure 6:
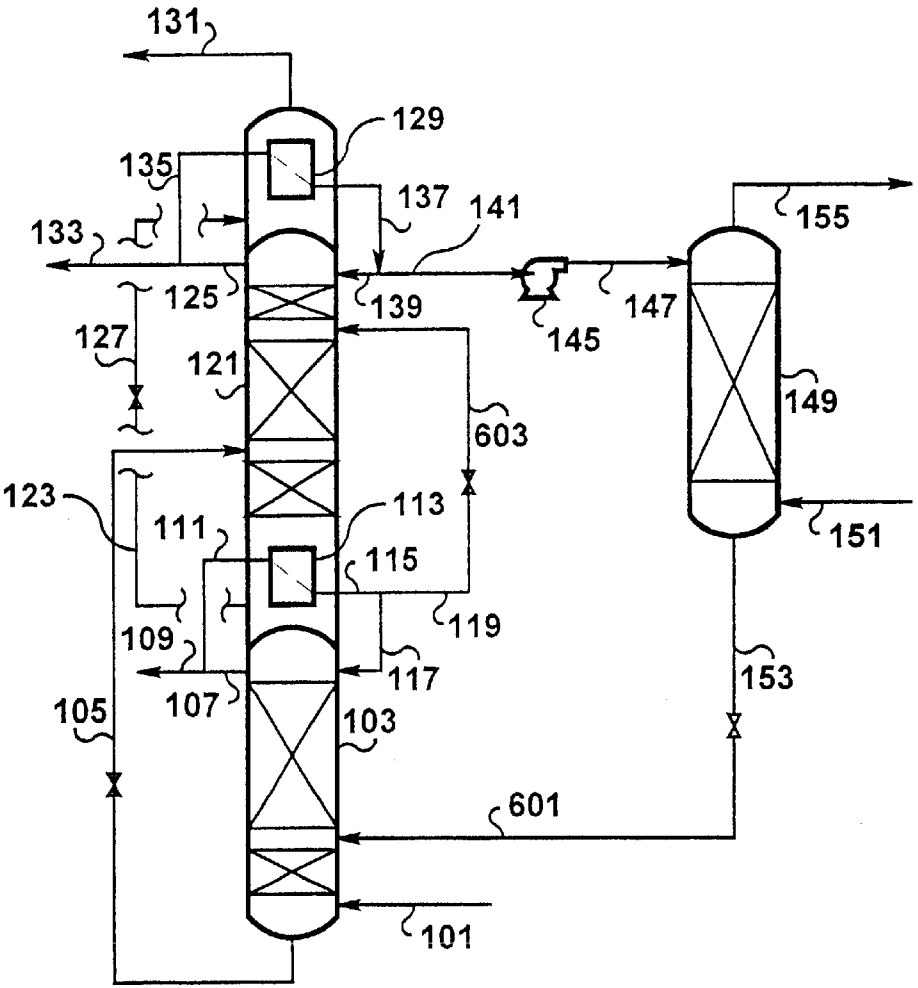
FIG. 6 is a schematic diagram of a sixth embodiment of the present invention.

FIG. 6 is an embodiment of the invention wherein the supplemental column 149 is refluxed solely from the lower-pressure column 121. Stream 153 is eventually reduced in pressure and is sent to the higher-pressure column 103 as stream 601. Stream 119 is eventually reduced in pressure and is sent to the lower-pressure column 121 as stream 603. Stream 603 is introduced into the lower-pressure column 121 at a feed position in that column below the feed position of stream 139. Stream 141 is eventually increased in pressure in pump 145 and is eventually sent to the supplemental column 149 as supplemental column reflux stream 147.

Figure 7:
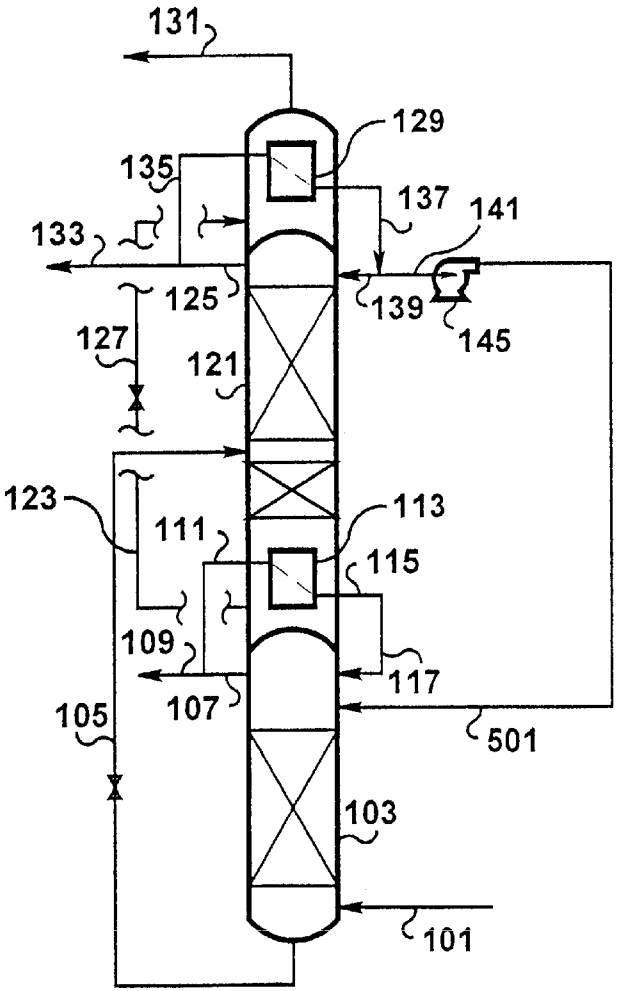
FIGURE 7 Prior Art
FIG. 7 is a schematic diagram of a prior art distillation column system.

FIG. 7 shows a prior art pump-back cycle similar to that disclosed in U.S. Pat. No. 5,964,104 (Rottmann).

Numerous modifications or additions may be applied to the embodiments shown in FIGS. 1–6. For example, the above discussion has centered around a process producing at least a nitrogen product. This nitrogen product has been shown as various streams, 109, 133, and 155. It will be apparent to persons skilled in the art that the invention may be applied where additional nitrogen streams at other purities and/or pressures may be required, necessitating the use of further columns. Additionally, the invention may be applied to a process where a single nitrogen product is required. An important feature of the invention is that a portion of the nitrogen product is removed from the supplemental column 149.

In the discussion above, the nitrogen product streams 109,133, and 155 each have been described as having a pressure equal to that of the corresponding column for the stream. However, the pressures of these streams may be changed before being delivered as product. Examples include but are not limited to: 1) pressure increased in a compressor, 2) pressure decreased in an expander, 3) pressure decreased in a throttling device, and 4) pressure decreased in a turboejector.

Refrigeration for the process has not been illustrated in the examples given, as this is not required to describe the essence of the invention. Persons skilled in the art will recognize that many alternate refrigeration means exist. Examples include but are not limited to: 1) expansion of a portion of the air component vapor stream 101 to the higher-pressure column 103, 2) expansion of a portion of the air component vapor stream 101 to the lower-pressure column 121, 3) expansion of a portion of the secondary air component vapor stream 151 to the supplemental column 149, and 4) expansion of a vapor from columns 103, 121, and 149, such as a portion of a nitrogen product.

In the discussion, reference is made to "eventually reduced in pressure" or similar terms or phrases (e.g., eventually changing, increasing or reducing the pressure). It will be understood by persons skilled in the art that this means that other processing steps may exist before the pressure reduction or change. For example, it is common practice to cool liquid streams prior to their introduction to the lower-pressure column 121. Warming cold returning vapor streams, such as waste stream 131, provides this cooling.

The reflux, or top feed, for the lower-pressure column 121 is shown as stream 139. Other optional reflux streams exist. Examples include but are not limited to: 1) a liquid from an intermediate location of the higher-pressure column 103; and 2) a portion of liquid stream 407 liquid from the top of the supplemental column 149. In such an event, stream 139 may or may not be optionally required.

In the discussion, reference is made to "eventually feeding" a stream to a column or similar terms or phrases (e.g., eventually sent, eventually fed, or eventually returned). It will be understood by persons skilled in the art that this means that other processing steps may exist before the stream is fed to the column. For example, "eventually feeding" may include multiple processing steps such as sending a first nitrogen-enriched stream to the higher-pressure column, withdrawing a second nitrogen-enriched stream from the higher-pressure column, and sending the second nitrogen-enriched stream to the supplemental column. The second nitrogen-enriched stream may be withdrawn from the higher-pressure column at the same stage where the first nitrogen-enriched stream is fed to that column or at multiple stages above or below that feed location.

WORKED EXAMPLE

In the following worked example of the invention, as found in FIG. 6, stream 153 is eventually sent to the bottom of the higher-pressure column 103. Further, only a single enriched nitrogen product is produced, stream 155, at a pressure of 302 psia. Flows and conditions for major streams can be found in Table 1.

TABLE 1

| Invention | | | | | | |
|---|---|---|---|---|---|---|
| | Molar Composition | | | | | |
| Stream | $N_2$ | $O_2$ | Ar | Pressure | Temperature | Flowrate |
| 101 | 78.12% | 20.95% | 0.93% | 87 psia | −270.4° F. | 55500 lb/hr |
| 105 | 64.54% | 33.95% | 1.51% | 87 psia | −279.5° F. | 109400 lb/hr |
| 131 | 45.84% | 51.87% | 2.29% | 18 psia | −301.56° F. | 70700 lb/hr |
| 147 | 99.94% | 1 ppm | 0.06% | 307 psia | −283.4° F. | 67800 lb/hr |
| 151 | 78.12% | 20.95% | 0.93% | 303 psia | −239.0° F. | 115200 lb/hr |
| 153 | 69.20% | 29.48% | 1.32% | 303 psia | −242.4° F. | 83000 lb/hr |
| 155 | 99.96% | 1 ppm | 0.04% | 302 psia | −250.1° F. | 100000 lb/hr |

| Column | Bottom Pressure |
|---|---|
| 103 | 87 psia |
| 121 | 50 psia |
| 149 | 303 psia |

In comparison, a worked example for the prior art, as found in FIG. 7, is discussed below. Once more a single nitrogen product, now stream 109, is produced. Again, the pressure of this stream is 302 psia. Flows and conditions for major streams in this example of the art can be found in Table 2.

TABLE 2

| Prior Art | | | | | | |
|---|---|---|---|---|---|---|
| Stream | $N_2$ | $O_2$ | Ar | Pressure | Temperature | Flowrate |
| 101 | 78.12% | 20.95% | 0.93% | 304 psia | −238.5° F. | 204000 lb/hr |
| 105 | 68.79% | 29.87% | 1.34% | 304 psia | −242.1° F. | 145000 lb/hr |
| 109 | 99.98% | 1 ppm | 0.02% | 302 psia | −250.1° F. | 100000 lb/hr |
| 131 | 55.51% | 42.59% | 1.90% | 79 psia | −273.5° F. | 104000 lb/hr |
| 501 | 99.96% | 1 ppm | 0.04% | 307 psia | −256.1° F. | 41000 lb/hr |

| Column | Bottom Pressure |
|---|---|
| 103 | 304 psia |
| 121 | 154 psia |

It can be seen that the prior art requires higher column pressures in the distillation unit than does the invention. Since higher-pressure columns tend to require thicker, more costly materials, the invention allows for a reduction of the costs involved with the distillation unit. Further, less feed air is required in the invention. Primarily, a large portion of the feed air, 67.5%, does not pass through the higher-pressure column 103; instead, it is sent directly to the supplemental column 149. Secondly, the prior art is able to extract about 63% of the nitrogen entering as feed air, while the invention is able to extract about 75%. The air fed to the higher-pressure column 103 is of a much lower flow and a lower pressure.

Although illustrated and described herein with reference to certain specific embodiments, the present invention is nevertheless not intended to be limited to the details shown. Rather, various modifications may be made in the details within the scope and range of equivalents of the claims and without departing from the spirit of the invention.

What is claimed is:

1. A process for separating a multi-component fluid comprising oxygen and nitrogen to produce nitrogen, said process using a distillation column system having at least three distillation columns, including a higher-pressure column operating at a first pressure, a lower-pressure column operating at a second pressure lower than the first pressure, and a supplemental column operating at a third pressure greater than or equal to the second pressure, wherein the higher-pressure column and the lower-pressure column are thermally linked through a first heat exchanger and each distillation column has a top, a bottom, and a plurality of locations between the top and the bottom, comprising the steps of:

feeding a first stream of the multi-component fluid to the higher-pressure column;

feeding a second stream of the multi-component fluid or another multi-component fluid compromising oxygen and nitrogen to the supplemental column;

withdrawing a first nitrogen-rich vapor stream from the higher-pressure column or the lower-pressure column;

withdrawing a first oxygen-rich liquid stream from the lower-pressure column;

heat exchanging at least a portion of the first oxygen-rich liquid stream indirectly against at least a portion of the first nitrogen-rich vapor stream in the first heat exchanger or a second heat exchanger, thereby at least partially vaporizing the first oxygen-rich liquid stream and at least partially condensing the first nitrogen-rich vapor stream;

eventually changing the pressure of at least a portion of the condensed first nitrogen-rich vapor stream;

eventually feeding at least a portion of the condensed first nitrogen-rich vapor stream to the supplemental column;

withdrawing a second oxygen-rich liquid stream from the supplemental column;

feeding at least a portion of the second oxygen-rich liquid stream to the lower-pressure column or the higher-pressure column; and withdrawing a first stream of nitrogen product from the supplemental column.

2. A process as in claim 1, wherein the pressure of the portion of the condensed first nitrogen-rich vapor stream is changed by increasing the pressure.

3. A process as in claim 1, wherein the pressure of the portion of the condensed first nitrogen-rich vapor stream is changed by reducing the pressure.

4. A process as in claim 2, comprising the further steps of:

withdrawing a second nitrogen-rich vapor stream from the supplemental column;

withdrawing a third oxygen-rich liquid stream from the lower-pressure column;

heat exchanging at least a portion of the third oxygen-rich liquid stream indirectly against at least a portion of the second nitrogen-rich vapor stream in a third heat exchanger, thereby at least partially condensing the second nitrogen-rich vapor-stream; and feeding at least a portion of the condensed second nitrogen-rich vapor stream to the supplemental column.

5. A process as in claim 3, comprising the further steps of:

withdrawing a second nitrogen-rich vapor stream from the lower-pressure column;

withdrawing a third oxygen-rich liquid stream from the lower-pressure column;

heat exchanging at least a portion of the third oxygen-rich liquid stream indirectly against at least a portion of the second nitrogen-rich vapor stream in a second heat exchanger, thereby at least partially condensing the second nitrogen-rich vapor-stream;

increasing the pressure of at least a portion of the condensed second nitrogen-rich vapor stream; and feeding at least a portion of the condensed second nitrogen-rich vapor stream to the higher-pressure column.

6. A process as in claim 1, wherein the third pressure is greater than or equal to the first pressure.

7. A process as in claim 1, comprising the further step of:

withdrawing a stream of a product enriched in nitrogen from the lower-pressure column.

8. A process as in claim 1, comprising the further step of:

withdrawing a stream of product enriched in nitrogen from the higher-pressure column.

9. A process as in claim 4, wherein:

a portion of the condensed first nitrogen-rich vapor stream is fed to the supplemental column at a first location; and a portion of the condensed second nitrogen-rich vapor stream is fed to the supplemental column at the first location or at a second location above the first location.

10. A process as in claim 1, wherein:

a first nitrogen-rich liquid stream from the first heat exchanger is fed to the lower-pressure column at a first location; and a second nitrogen-rich liquid stream from the second heat exchanger is fed to the lower-pressure column at a second location above the first location.

11. A cryogenic air separation unit using a process as in claim 1.

* * * * *